US008524013B2

(12) United States Patent
Taihaku et al.

(10) Patent No.: US 8,524,013 B2
(45) Date of Patent: Sep. 3, 2013

(54) PERMANENT MAGNET AND MANUFACTURING METHOD THEREOF

(75) Inventors: Keisuke Taihaku, Ibaraki (JP); Katsuya Kume, Ibaraki (JP); Izumi Ozeki, Ibaraki (JP); Tomohiro Omure, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 13/499,415

(22) PCT Filed: Apr. 28, 2011

(86) PCT No.: PCT/JP2011/060403

§ 371 (c)(1),
(2), (4) Date: Mar. 30, 2012

(87) PCT Pub. No.: WO2011/142275

PCT Pub. Date: Nov. 17, 2011

(65) Prior Publication Data

US 2012/0188038 A1 Jul. 26, 2012

(30) Foreign Application Priority Data

May 14, 2010 (JP) ..... 2010-112381

(51) Int. Cl.
*H01F 1/057* (2006.01)

(52) U.S. Cl.
USPC ..... 148/101; 75/244; 148/302; 419/22

(58) Field of Classification Search
USPC ..... 148/101, 302; 75/244; 419/12
See application file for complete search history.

(56) References Cited

U.S. PATENT DOCUMENTS

| | | | | |
|---|---|---|---|---|
| 2005/0133117 | A1* | 6/2005 | Tayu et al. | 148/105 |
| 2011/0267160 | A1* | 11/2011 | Ozeki et al. | 335/302 |
| 2012/0181475 | A1* | 7/2012 | Ozeki et al. | 252/62.51 R |
| 2012/0181476 | A1* | 7/2012 | Ozeki et al. | 252/62.51 R |
| 2012/0182105 | A1* | 7/2012 | Ozeki et al. | 335/302 |
| 2012/0182106 | A1* | 7/2012 | Ozeki et al. | 335/302 |
| 2012/0182107 | A1* | 7/2012 | Ozeki et al. | 335/302 |
| 2012/0182108 | A1* | 7/2012 | Ozeki et al. | 335/302 |
| 2012/0182109 | A1* | 7/2012 | Ozeki et al. | 335/302 |
| 2012/0187326 | A1* | 7/2012 | Ozeki et al. | 252/62.51 R |

(Continued)

FOREIGN PATENT DOCUMENTS

| | | | |
|---|---|---|---|
| JP | 7-278857 | A | 10/1995 |
| JP | 2000-109992 | * | 4/2000 |

(Continued)

*Primary Examiner* — Roy King
*Assistant Examiner* — Timothy Haug
(74) *Attorney, Agent, or Firm* — Sughrue Mion PLLC

(57) ABSTRACT

There are provided a permanent magnet and a manufacturing method thereof capable of manufacturing metal alkoxide in better work environment, simpler production facilities and easier manufacturing process and also reducing the manufacturing costs. An electrolytic solution is obtained through dissolving chloride or injecting hydrogen chloride gas into alcohol which is same alcohol as is a constituent element of metal alkoxide to be manufactured. Then, electrolysis is performed on the electrolytic solution while using, for an anode, a ferroalloy that contains iron and metal which is a constituent element of the metal alkoxide to be manufactured in a predetermined weight ratio (such as 1:1), and, for a cathode, the same ferroalloy, carbon, platinum or stainless steel, so as to obtain an alcohol solution of the metal alkoxide. Then, a permanent magnet is manufactured using the alcohol solution of the metal alkoxide thus obtained.

5 Claims, 4 Drawing Sheets

(56) References Cited

U.S. PATENT DOCUMENTS

| | | | | |
|---|---|---|---|---|
| 2012/0187327 | A1* | 7/2012 | Ozeki et al. | 252/62.51 R |
| 2012/0187328 | A1* | 7/2012 | Ozeki et al. | 252/62.51 R |
| 2012/0187612 | A1* | 7/2012 | Ozeki et al. | 264/612 |
| 2012/0194310 | A1* | 8/2012 | Ozeki et al. | 335/302 |

FOREIGN PATENT DOCUMENTS

| | | | |
|---|---|---|---|
| JP | 2000-109992 | A | 4/2000 |
| JP | 3298219 | B2 | 4/2002 |
| JP | 2005-191187 | A | 7/2005 |
| JP | 2009-259956 | A | 11/2009 |

* cited by examiner

PERMANENT MAGNET AND MANUFACTURING METHOD THEREOF

CROSS REFERENCE TO RELATED APPLICATIONS

This application is a National Stage of International Application No. PCT/JP2011/060403 filed Apr. 28, 2011, claiming priority based on Japanese Patent Application No. 2010-112381 filed May 14, 2010, the contents of all of which are incorporated herein by reference in their entirety.

TECHNICAL FIELD

The present invention relates to a permanent magnet and manufacturing method thereof.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, a further improvement in magnetic performance is required of a permanent magnet to be buried in the permanent magnet motor. Meanwhile, as permanent magnet, there have been known ferrite magnets, Sm—Co-based magnets, R-T-B-based magnets, $Sm_2Fe_{17}N_x$-based magnets or the like. As permanent magnet for permanent magnet motor, there are typically used R-T-B-based magnets among them due to remarkably high residual magnetic flux density.

As method for manufacturing a permanent magnet, a powder sintering process is generally used. In this powder sintering process, raw material is coarsely milled first and furthermore, is finely milled into magnet powder by a jet mill (dry-milling) method. Thereafter, the magnet powder is put in a mold and pressed to form in a desired shape with magnetic field applied from outside. Then, the magnet powder formed and solidified in the desired shape is sintered at a predetermined temperature (for instance, at a temperature between 800 and 1150 degrees Celsius for the case of Nd—Fe—B-based magnet) for completion.

PRIOR ART DOCUMENT

Patent Document

Patent document 1: Japanese Registered Patent Publication No. 3298219 (pages 4 and 5)

DISCLOSURE OF THE INVENTION

Problem to be Solved by the Invention

Furthermore, in the above method for manufacturing a permanent magnet, the permanent magnet may be manufactured using metal alkoxide. For example, it has been known that basically the magnetic performance of a permanent magnet can be improved by making the crystal grain size in a sintered body very fine, because the magnetic characteristics of a magnet can be approximated by a theory of single-domain particles. Here, in order to make the grain size in the sintered body very fine, a particle size of the magnet raw material before sintering also needs to be made very fine. However, even if the magnet raw material finely milled into a very fine particle size is compacted and sintered, grain growth occurs in the magnet particles at the time of sintering. Therefore, after sintering, the crystal grain size in the sintered body has increased to be larger than the size before sintering, and as a result, it has been impossible to achieve a very fine crystal grain size. In addition, even if the size of the sintered magnet particles can be successfully decreased to be very fine through inhibiting the grain growth, there still is a possibility that exchange interaction is propagated among the sintered magnet particles when the sintered magnet particles are densely aggregated. As a result, when a magnetic field is applied from outside, magnetic reversal easily occurs in the magnet particles so that the coercive force is decreased, which has been problematic.

Here, if metal alkoxide consisting at least of refractory metal such as V, Mo, Zr, Ta, Ti, W or Nb is added to the milled magnet powder, Nb or the like contained in the metal alkoxide can efficiently be concentrated at grain boundaries of a magnet. As a result, grain growth in magnet particles at sintering can be suppressed, magnetization reversal in the magnet particles can be prevented through disrupting exchange interaction among magnet particles and magnetic performance can be improved.

Meanwhile, if metal alkoxide consisting at least of Dy or Tb is added to the milled magnet powder, a very small amount of Dy or Tb included in the metal alkoxide can be efficiently concentrated at the grain boundaries of the magnet. Consequently, usage of Dy or Tb is reduced while improvement of coercive force can be sufficiently realized.

Conventionally, the metal alkoxide has been manufactured in the following method.

First, refining is performed to a metal which is to be a constituent element of the metal alkoxide to be manufactured, and then the refined metal is reacted with chlorine gas to produce a metal chloride (such as tantalum pentachloride or niobium pentachloride). Thereafter, the metal chloride is dissolved in alcohol which is the same alcohol as is to be a constituent element of the metal alkoxide to be manufactured, and then neutralized by ammonia. By-produced ammonium chloride is precipitated, separated and removed, and the remnant liquid is distilled to obtain the metal alkoxide to be manufactured.

However, the above method requires careful attention about work environment for using chlorine gas, as the chlorine gas has low reactivity to metal. Furthermore, unreacted chlorine gas has to be treated with a scrubber or the like; therefore large production facilities have been needed. Furthermore, in transforming metal chloride into metal alkoxide, a large amount of ammonium chloride is by-produced, which has to be removed. This impedes mass production thereof due to such requirement as the large facilities conscious of safety in processing combustible liquid mixture. In addition thereto, the large amount of by-produced ammonium chloride has become a cause of impure substances included in the metal alkoxide of finished product. Also, the above method requires extra processes such as metal refining and distillation, which results in complicated manufacturing processes and increase in manufacturing costs.

The present invention has been made to resolve the above described conventional problems and the object thereof is to provide a permanent magnet and manufacturing method thereof capable of manufacturing metal alkoxide in better work environment, simpler production facilities and easier manufacturing processes than those conventionally employed, and also reducing the manufacturing costs.

Means for Solving the Problem

To achieve the above object, the present invention provides a permanent magnet manufactured through steps of: preparing an electrolytic solution through one of dissolving chloride and injecting hydrogen chloride gas, into alcohol which is same alcohol as is a constituent element of metal alkoxide to be manufactured; performing electrolysis on the electrolytic solution while using, for an anode, a ferroalloy containing iron and M (M representing metal which is a constituent element of the metal alkoxide to be manufactured) in a predetermined weight ratio and, for a cathode, one of the ferroalloy, carbon, platinum and stainless steel to obtain an alcohol solution of the metal alkoxide; milling magnet material into magnet powder; adhering the metal alkoxide to particle surfaces of the magnet powder through adding the metal alkoxide contained in the alcohol solution of the metal alkoxide obtained at the step of performing electrolysis, to the magnet powder obtained at the step of milling magnet material; compacting the magnet powder having the metal alkoxide adhere on the particle surfaces thereof so as to obtain a compact body; and sintering the compact body.

The above-described permanent magnet of the present invention is manufactured further through steps of: introducing ammonia gas into the alcohol solution of the metal alkoxide obtained at the step of performing electrolysis, to deposit ammonium chloride precipitate; and removing the ammonium chloride precipitate from the alcohol solution of the metal alkoxide, wherein in the step of adhering the metal alkoxide to particle surfaces of the magnet powder, the alcohol solution of the metal alkoxide from which the ammonium chloride precipitate is removed is added to the magnet powder obtained at the step of milling magnet material.

In the above-described permanent magnet of the present invention, in the step of adhering the metal alkoxide to particle surfaces of the magnet powder, the alcohol solution of the metal alkoxide obtained at the step of performing electrolysis is mixed with the magnet powder obtained at the step of milling magnet material so as to add the metal alkoxide in a wet state.

In the above-described permanent magnet of the present invention, M includes one of vanadium, molybdenum, zirconium, tantalum, titanium, tungsten and niobium.

To achieve the above object, the present invention further provides a manufacturing method of a permanent magnet comprising steps of: preparing an electrolytic solution through one of dissolving chloride and injecting hydrogen chloride gas, into alcohol which is same alcohol as is a constituent element of metal alkoxide to be manufactured; performing electrolysis on the electrolytic solution while using, for an anode, a ferroalloy containing iron and M (M representing metal which is a constituent element of the metal alkoxide to be manufactured) in a predetermined weight ratio and, for an cathode, one of the ferroalloy, carbon, platinum and stainless steel to obtain an alcohol solution of the metal alkoxide; milling magnet material into magnet powder; adhering the metal alkoxide to particle surfaces of the magnet powder through adding the metal alkoxide contained in the alcohol solution of the metal alkoxide obtained at the step of performing electrolysis, to the magnet powder obtained at the step of milling magnet material; compacting the magnet powder having the metal alkoxide adhered on the particle surfaces thereof so as to obtain a compact body; and sintering the compact body.

The above-described manufacturing method of the permanent magnet of the present invention, further includes steps of: introducing ammonia gas into the alcohol solution of the metal alkoxide obtained at the step of performing electrolysis, to deposit ammonium chloride precipitate; and removing the ammonium chloride precipitate from the alcohol solution of the metal alkoxide, wherein, in the step of adhering the metal alkoxide to particle surfaces of the magnet powder, the alcohol solution of the metal alkoxide from which the ammonium chloride precipitate is removed is added to the magnet powder obtained at the step of milling magnet material.

In the above-described manufacturing method of the permanent magnet of the present invention, in the step of adhering the metal alkoxide to particle surfaces of the magnet powder, the alcohol solution of the metal alkoxide obtained at the step of performing electrolysis is mixed with the magnet powder obtained at the step of milling magnet material so as to add the metal alkoxide in a wet state.

In the above-described manufacturing method of the permanent magnet, M includes one of vanadium, molybdenum, zirconium, tantalum, titanium, tungsten and niobium.

Effect of the Invention

According to the permanent magnet of the present invention having the above configuration, in a process of manufacturing metal alkoxide included in the manufacturing processes, there is no need for processes such as a metal refining process, a reaction process of metal and chlorine gas and a conversion process from metal chloride to metal alkoxide. The work environment is improved compared to the conventional environment and it becomes possible to manufacture metal alkoxide with simpler production facilities and manufacturing processes. Furthermore, manufacturing costs can also be reduced. In addition, as a ferroalloy can be used for an anode and a cathode, metal refining for the metal to be used for the anode and the cathode can also become unnecessary, compared with a case where the metal which is a constituent element of metal alkoxide to be manufactured only is used as the anode and the cathode.

Further, when the metal alkoxide is added to the magnet powder in the manufacturing process, the metal alkoxide can be added in a state of the alcohol solution, therefore it can be configured to omit the process through distillation to take out the metal alkoxide from the alcohol solution of the metal alkoxide. As a result, it becomes possible to simplify the manufacturing processes of the metal alkoxide and the permanent magnet. Furthermore, it is made possible to make the metal alkoxide containing M evenly adhere on particle surfaces of the magnet particles, so that M can be effectively concentrated with respect to the grain boundaries of the magnet after sintering.

As a result, for instance, if M is refractory metal such as V, Mo, Zr, Ta, Ti, W or Nb, grain growth can be prevented in the magnet particles at sintering, and at the same time exchange interaction can be disrupted among the magnet particles so as to prevent magnetization reversal in the magnet particles, making it possible to improve the magnetic performance thereof.

Meanwhile, if M is Dy or Tb, a very small amount of Dy or Tb can be efficiently concentrated in a grain boundary of the magnet. Consequently, usage of Dy or Tb is reduced while improvement of coercive force can be sufficiently realized.

According to the permanent magnet of the present invention, in a process of manufacturing metal alkoxide included in the manufacturing processes, it becomes possible to remove the chloride ion included in the alcohol solution of metal alkoxide after electrolysis, so that the alcohol solution of metal alkoxide with fewer foreign substances can be obtained.

According to the permanent magnet of the present invention, when the metal alkoxide is added to the magnet powder in the manufacturing process, the metal alkoxide can be added in a state of the alcohol solution, which eliminates the need for the process through distillation to take out the metal alkoxide from the alcohol solution of the metal alkoxide. As a result, it is made possible to simplify the manufacturing processes of the permanent magnet. Furthermore, it becomes possible to make the metal alkoxide containing M evenly adhere on each particle surface of the magnet particles, so that M can be effectively concentrated with respect to the grain boundaries of the magnet after sintering.

According to the permanent magnet of the present invention, V, Mo, Zr, Ta, Ti, W or Nb included in the metal alkoxide contained in the added metal alkoxide can prevent grain growth in the magnet particles at sintering, and at the same time through disrupting exchange interaction among the magnet particles, magnetization reversal in the magnet particles can be prevented, making it possible to improve the magnetic performance of the permanent magnet.

According to the manufacturing method of a permanent magnet of the present invention, in a process of manufacturing metal alkoxide, there is no need for processes such as a metal refining process, a reaction process of metal and chlorine gas and a conversion process from metal chloride to metal alkoxide. The work environment is improved compared to the conventional environment and it becomes possible to manufacture metal alkoxide with simpler production facilities and manufacturing processes. Furthermore, manufacturing costs can also be reduced. In addition, as a ferroalloy can be used for an anode and a cathode, metal refining for the metal to be used for the anode and the cathode can also become unnecessary, compared with a case where only the metal which is a constituent element of metal alkoxide to be manufactured is used as the anode and the cathode.

Further, when the metal alkoxide is added to the magnet powder in the manufacturing process, the metal alkoxide can be added in a state of the alcohol solution, therefore it can be configured to omit the process through distillation to take out the metal alkoxide from the alcohol solution of the metal alkoxide. As a result, it becomes possible to simplify the manufacturing processes of the metal alkoxide and the permanent magnet. Furthermore, it is made possible to make the metal alkoxide containing M evenly adhere on particle surfaces of the magnet particles, so that M can be effectively concentrated with respect to the grain boundaries of the magnet after sintering.

As a result, for instance, if M is refractory metal such as V, Mo, Zr, Ta, Ti, W or Nb, grain growth can be prevented in the magnet particles at sintering, and at the same time exchange interaction can be disrupted among the magnet particles so as to prevent magnetization reversal in the magnet particles, making it possible to improve the magnetic performance of the permanent magnet.

Meanwhile, if M is Dy or Tb, very small amount of Dy or Tb can be efficiently concentrated in a grain boundary of the magnet. Consequently, usage of Dy or Tb is reduced while improvement of coercive force of the permanent magnet can be sufficiently realized.

According to the manufacturing method of a permanent magnet of the present invention, in a process of manufacturing metal alkoxide, it becomes possible to remove the chloride ion included in the alcohol solution of metal alkoxide after electrolysis, so that the alcohol solution of metal alkoxide with fewer foreign substances can be obtained.

Further, according to the manufacturing method of a permanent magnet of the present invention, when the metal alkoxide is added to the magnet powder, the metal alkoxide can be added in a state of the alcohol solution, which eliminates the need for the process through distillation to take out the metal alkoxide from the alcohol solution of the metal alkoxide. As a result, it is made possible to simplify the manufacturing processes of the permanent magnet. Furthermore, it becomes possible to make the metal alkoxide containing M evenly adhere on particle surfaces of the magnet particles, so that M can be effectively concentrated with respect to the grain boundaries of the magnet after sintering.

Still further, according to the manufacturing method of a permanent magnet of the present invention, V, Mo, Zr, Ta, Ti, W or Nb included in the metal alkoxide can prevent grain growth in the magnet particles at sintering, and at the same time through disrupting exchange interaction among the magnet particles, magnetization reversal in the magnet particles can be prevented, making it possible to improve the magnetic performance of the permanent magnet.

BEST MODE FOR CARRYING OUT THE INVENTION

Specific embodiments of a permanent magnet and a method for manufacturing the permanent magnet according to the present invention will be described below in detail with reference to the drawings.

[Constitution of Metal Alkoxide]

First, metal alkoxide which is to be used in the manufacturing of a permanent magnet will be described.

The metal alkoxide to be used in this invention is expressed by such a general formula as $M(OR)_n$ (M: at least one kind of metal element, R: organic group, n: valence of metal or metalloid). Furthermore, examples of metal or metalloid composing the metal alkoxide include W, Mo, V, Nb, Ta, Ti, Zr, Ir, Fe, Co, Ni, Cu, Zn, Cd, Al, Ga, In, Dy, Tb, Ge, Sb, Y, lanthanide and the like.

However, in the present invention, the metal alkoxide is adhered on the particle surfaces in milled magnet powder as later described, and used for the purpose of inhibiting the grain growth of the magnet particles in a sintering process and preventing the inter-diffusion with the main phase of the magnet. Therefore M is set to include one of V, Mo, Zr, Ta, Ti, W and Nb, all of which are refractory metal. In the example below, a case where niobium and iron are used for M is specifically discussed.

Furthermore, the types of the alkoxide are not specifically limited, and there may be used, for instance, methoxide, ethoxide, propoxide, isopropoxide, butoxide or alkoxide carbon number of which is 4 or larger. However, in the present invention, those of low-molecule weight are used in order to reduce the carbon residue by means of thermal decomposition at a low temperature in the manufacturing processes of the permanent magnet using metal alkoxide as later described. Furthermore, methoxide carbon number of which is 1 is prone to decompose and difficult to deal with, therefore it is preferable to use alkoxide carbon number of which is 2 through 6, such as ethoxide, methoxide, isopropoxide, propoxide or butoxide.

[Method for Manufacturing Metal Alkoxide]

Figure 1:
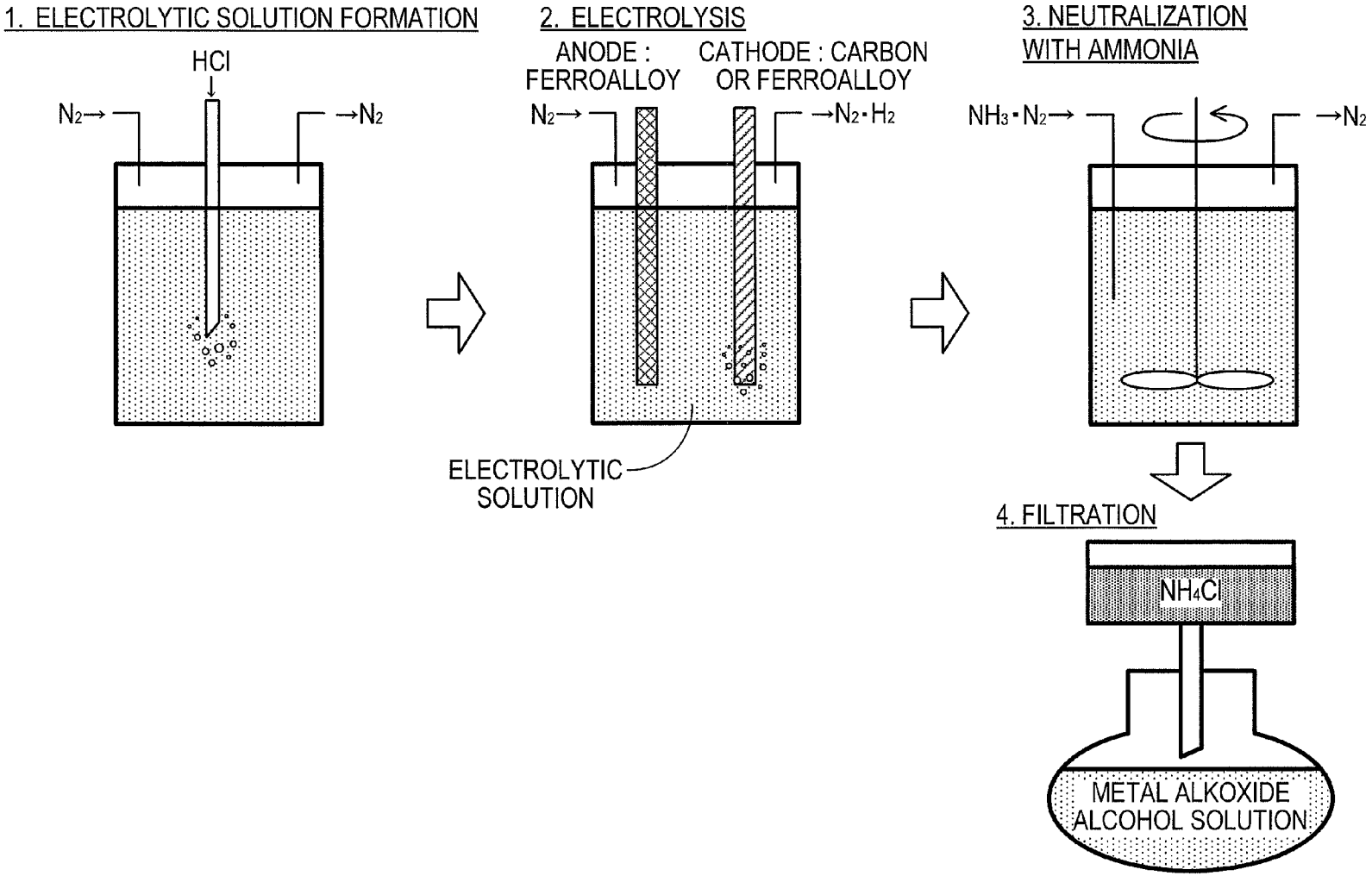
[FIG. 1] is an explanatory diagram illustrating manufacturing processes of metal alkoxide according to a manufacturing method of the invention.

Next, a manufacturing method of metal alkoxide to be used in the present invention will be discussed referring to FIG. 1. The example below shows a case where niobium-iron ethoxide is manufactured as metal alkoxide.

First, inert gas (such as nitrogen gas) is introduced into an electrolytic cell equipped with a stirrer and the electrolytic cell is filled with 300 g of alcohol. The alcohol to fill is the same alcohol as is a constituent element of the metal alkoxide to be manufactured. Accordingly, ethanol is used when manufacturing niobium-iron ethoxide.

After that, hydrogen chloride gas is injected and dissolved in the alcohol filling the electrolytic cell for 350-400 ml/min to obtain an electrolytic solution. Incidentally, the configuration may be such that a chloride (such as tantalum pentachloride) is dissolved in the alcohol instead of injecting the hydrogen chloride gas.

Next, an anode is prepared using a ferroalloy and a cathode is prepared using one of the same ferroalloy, carbon, platinum, stainless steel and the like. Then electric current of DC 10 V is applied thereto to perform electrolysis for 20 hours so that an alcohol solution of metal alkoxide is obtained. The ferroalloy to be used for the anode or cathode contains iron and metal which is the same metal as is a constituent element of the metal alkoxide to be manufactured, in a predetermined weight ratio (such as 1:1). Accordingly, a ferroalloy containing Nb and Fe in a predetermined weight ratio is used when manufacturing the niobium-iron ethoxide.

After that, ammonia gas is introduced to the alcohol solution of the metal alkoxide obtained through the electrolysis, and the chloride ion of the hydrogen chloride used as the electrolytic solution is neutralized to deposit in a form of white precipitate of ammonium chloride.

Following that, the precipitate of ammonium chloride which has deposited is filtrated and removed, thus there is obtained the alcohol solution of the metal alkoxide from which the chloride ion is removed. The alcohol solution of the metal alkoxide which is manufactured may be distilled to take out the metal alkoxide separately from the alcohol solution of the metal alkoxide. However, in the manufacturing process of a magnet, it is desirable to use the metal alkoxide in a state of the alcohol solution without performing a distillation process because the metal alkoxide has to be added to the magnet powder in a wet state, as later described. That eliminates the need for the distillation process, making it possible to simplify the manufacturing process.

[Method for Manufacturing Permanent Magnet]

Figure 2:
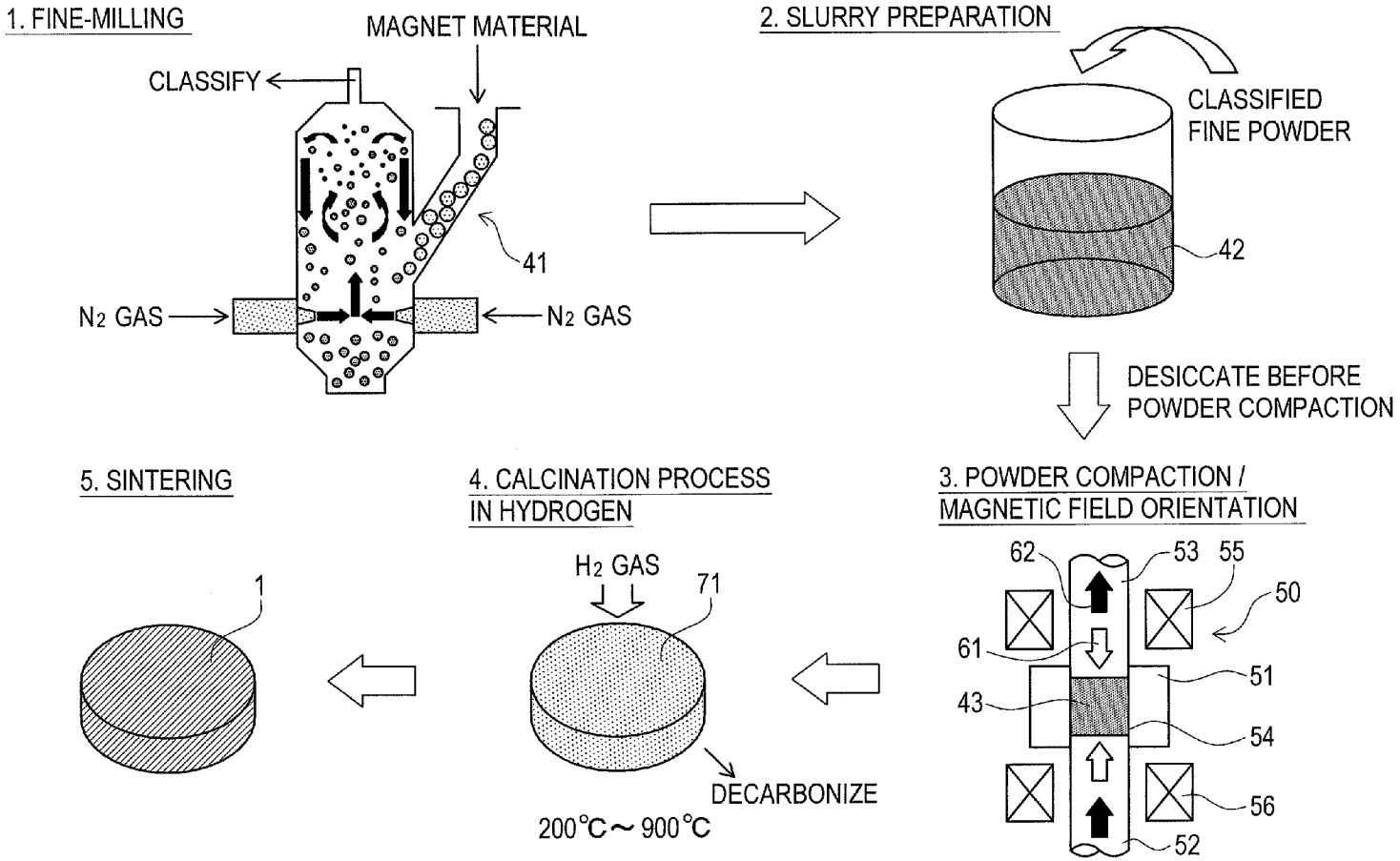
[FIG. 2] is an explanatory diagram illustrating manufacturing processes of a permanent magnet according to a manufacturing method of the invention.

Next, with reference to FIG. 2, there will be described one example of methods for manufacturing the permanent magnet 1 using metal alkoxide manufactured by the above manufacturing method (to be described hereinafter using niobium-iron ethoxide as an example). FIG. 2 is an explanatory view illustrating a manufacturing process in a method for manufacturing the permanent magnet 1 directed to the present invention.

First, there is manufactured an ingot comprising Nd—Fe—B of certain fractions (for instance, Nd: 26.7 wt %, Fe (electrolytic iron): 72.3 wt %, and B: 1.0 wt %). Thereafter the ingot is coarsely milled using a stamp mill, a crusher, etc. to a size of approximately 200 μm. Otherwise, the ingot is dissolved, formed into flakes using a strip-casting method, and then coarsely powdered using a hydrogen pulverization method.

Next, the coarsely milled magnet powder is finely milled with a jet mill 41 to form fine powder of which the average particle diameter is smaller than a predetermined size (for instance, 0.1 μm through 5.0 μm) in: (a) an atmosphere composed of inert gas such as nitrogen gas, argon (Ar) gas, helium (He) gas or the like having an oxygen content of substantially 0%; or (b) an atmosphere composed of inert gas such as nitrogen gas, Ar gas, He gas or the like having an oxygen content of 0.0001 through 0.5%. Here, the term "having an oxygen content of substantially 0%" is not limited to a case where the oxygen content is completely 0%, but may include a case where oxygen is contained in such an amount as to allow slight formation of an oxide film on the surface of the fine powder.

Successively, the alcohol solution of metal alkoxide prepared by the above-described manufacturing method of metal alkoxide is added to the fine powder classified at the jet mill 41. Through this, slurry 42 in which the fine powder of magnet raw material is mixed with the alcohol solution of metal alkoxide is prepared. Here, the addition of the alcohol solution of metal alkoxide is performed in an atmosphere composed of inert gas such as nitrogen gas, Ar gas or He gas. Furthermore, the amount of the alcohol solution of metal alkoxide to be mixed is not particularly limited; however, it is preferably adjusted to such an amount that the niobium content with respect to the sintered magnet is 0.001 wt % through 10 wt %, or more preferably, 0.01 wt % through 5 wt %.

Thereafter, the prepared slurry 42 is desiccated in advance through vacuum desiccation or the like before compaction and desiccated magnet powder 43 is obtained. Then, the desiccated magnet powder is subjected to powder-compaction to form a given shape using a compaction device 50. There are dry and wet methods for the powder compaction, and the dry method includes filling a cavity with the desiccated fine powder and the wet method includes preparing slurry of the desiccated fine powder using solvent and then filling a cavity therewith. In this embodiment, a case where the dry method is used is described as an example. Furthermore, the alcohol solution of metal alkoxide can be volatilized at the sintering stage after compaction.

As illustrated in FIG. 2, the compaction device 50 has a cylindrical mold 51, a lower punch 52 and an upper punch 53, and a space surrounded therewith forms a cavity 54. The lower punch 52 slides upward/downward with respect to the mold 51, and the upper punch 53 slides upward/downward with respect to the mold 51, in a similar manner.

In the compaction device 50, a pair of magnetic field generating coils 55 and 56 is disposed in the upper and lower positions of the cavity 54 so as to apply magnetic flux to the magnet powder 43 filling the cavity 54. The magnetic field to be applied may be, for instance, 1 MA/m.

When performing the powder compaction, firstly, the cavity 54 is filled with the desiccated magnet powder 43. Thereafter, the lower punch 52 and the upper punch 53 are activated to apply pressure against the magnet powder 43 filling the cavity 54 in a pressurizing direction of arrow 61, thereby performing compaction thereof. Furthermore, simultaneously with the pressurization, pulsed magnetic field is applied to the magnet powder 43 filling the cavity 54, using the magnetic field generating coils 55 and 56, in a direction of arrow 62 which is parallel with the pressuring direction. As a result, the magnetic field is oriented in a desired direction. Incidentally, it is necessary to determine the direction in which the magnetic field is oriented while taking into consideration the magnetic field orientation required for the permanent magnet 1 formed from the magnet powder 43.

Furthermore, in a case where the wet method is used, slurry maybe injected while applying the magnetic field to the cavity 54, and in the course of the injection or after termination of the injection, a magnetic field stronger than the initial magnetic field may be applied to perform the wet molding. Furthermore, the magnetic field generating coils 55 and 56 may be disposed so that the application direction of the magnetic field is perpendicular to the pressuring direction.

Secondly, the compact body 71 formed through the powder compaction is held for several hours (for instance, five hours) in hydrogen atmosphere at 200 through 900 degrees Celsius, or more preferably 400 through 900 degrees Celsius (for instance, 600 degrees Celsius), to perform a calcination process in hydrogen. The hydrogen feed rate during the calcination is 5 L/min. So-called decarbonization is performed during this calcination process in hydrogen. In the decarbonization, the organometallic material is thermally decomposed so that carbon content in the calcined body can be decreased. Furthermore, calcination process in hydrogen is to be performed under a condition of 1000 ppm carbon content or less in the calcined body, or more preferably 500 ppm or less. Accordingly, it becomes possible to densely sinter the permanent magnet 1 as a whole in the following sintering process, and the decrease in the residual magnetic flux density and coercive force can be prevented. Incidentally, the above hydrogen calcination process may be configured to be performed on the magnet powder before compaction. The configuration may be such that the magnet powder 43 is obtained through desiccating the slurry 42 in vacuum desiccation and the like, and processed by the hydrogen calcination process, and after that, the hydrogen-calcined magnet powder 43 is compacted and oriented by the compaction device 50.

Following the above, there is performed a sintering process for sintering the compact body 71 calcined through the calcination process in hydrogen. In the sintering process, the temperature is risen to approximately 800 through 1080 degrees Celsius in a given rate of temperature increase and held for approximately two hours. During this period, the vacuum sintering is performed, and the degree of vacuum is preferably equal to or smaller than $10^{-4}$ Torr. The compact body 71 is then cooled down, and again undergoes a heat treatment in 600 degrees Celsius for two hours. As a result of the sintering, the permanent magnet 1 is manufactured.

[Constitution of Permanent Magnet]

Metal which is a constituent element of the metal alkoxide (in a case where niobium-iron ethoxide is used, Nb and Fe) is concentrated on the boundary faces (grain boundaries) of Nd crystal grains forming the permanent magnet manufactured in the above manufacturing method. Hereinafter, an explanation is made on a case of the permanent magnet 1 manufactured using the niobium-iron ethoxide as metal alkoxide.

Figure 3:
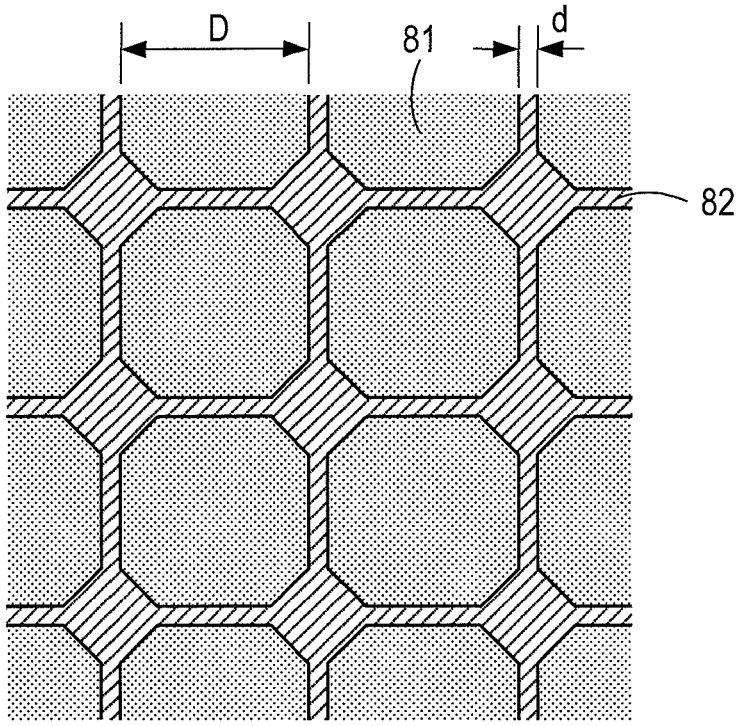
[FIG. 3] is an enlarged schematic view in vicinity of grain boundaries of the permanent magnet directed to the invention.

Specifically, in the permanent magnet 1 according to the present invention, Nb is concentrated at the grain boundaries of the Nd crystal grains 81 by generating a layer 82 (hereinafter referred to as refractory metal layer 82) in which Nb being a refractory metal substitutes for part of Nd on each surface (outer shell) of the Nd crystal grains 81 constituting the permanent magnet 1 as depicted in FIG. 3. FIG. is an enlarged view showing the Nd crystal grains 81 constituting the permanent magnet 1.

Here, in the present invention, substitution for Nb is performed through adding the niobium-iron ethoxide before compaction of the magnet powder which is milled as described above. Specifically, when sintering the magnet powder in which the niobium-iron ethoxide is added, Nb in the niobium-iron ethoxide, which is evenly adhered on the surfaces of the Nd crystal grains 81 through wet dispersion, diffusively intrudes into the grain growth region of each of the Nd crystal grains 81 and the substitution occurs, so that refractory metal layer 82 is formed as illustrated in FIG. 3. Nd crystal grains 81 are, for instance, composed of an $Nd_2Fe_{14}B$ intermetallic compound, and the refractory metal layer 82 is, for instance, composed of a NbFeB intermetallic compound.

Furthermore, a compact body compacted through powder compaction can be sintered under appropriate sintering conditions so that Nb or Fe can be prevented from being diffused or penetrated (solid-solutionized) into the magnet particles. Thus, in the present invention, even if Nb or Fe is added, Nb or Fe can be concentrated only within the grain boundaries after sintering. As a result, the phase of the $Nd_2Fe_{14}B$ intermetallic compound of the core accounts for the large proportion in volume, with respect to crystal grains as a whole (in other words, the sintered magnet in its entirety). Accordingly, the decrease of the residual magnetic flux density (magnetic flux density at the time when the intensity of the external magnetic field is brought to zero) can be inhibited. Furthermore, if iron contained in the added niobium-iron ethoxide is present in grain boundaries, the iron does not deteriorate the property of the magnet, unlike alpha iron. Therefore the magnetic property thereof can be prevented from deteriorating.

Further, generally, in a case where sintered Nd crystal grains 81 are densely aggregated, exchange interaction is presumably propagated among the Nd crystal grains 81. As a result, when a magnetic field is applied from outside, magnetization reversal easily takes place in the crystal grains, and coercive force thereof decreases even if sintered crystal grains can be made to have a single domain structure. However, in the present invention, there are provided refractory metal layers 82 which are nonmagnetic and coat the surfaces of the Nd crystal grains 81, and the refractory metal layers 82 disrupt the exchange interaction among the Nd crystal grains 81. Accordingly, magnetization reversal can be prevented in the crystal grains, even if a magnetic field is applied from outside.

Furthermore, the refractory metal layers 82 coating the surfaces of the Nd crystal grains 81 also operate as means of inhibiting what-is-called grain growth in which an average particle diameter increases in Nd crystal grains 81 at the sintering of the permanent magnet 1.

Generally, there is excessive energy in a grain boundary which is an inconsistent interfacial boundary left between a crystal and another crystal. As a result, at high temperature, grain boundary migration occurs in order to lower the energy. Accordingly, when the magnet raw material is sintered at high temperature (for instance, 800 through 1150 degrees Celsius for Nd—Fe—B-based magnets), small magnet particles shrink and disappear, and remaining magnet particles grow in average diameter, in other words, what-is-called grain growth occurs.

Here, in the present invention, through concentrating Nb, the refractory metal, on the surfaces of the interfacial boundary of magnet particles, due to the concentrated refractory metal, the grain boundary migration which easily occurs at high temperature can be prevented, and grain growth can be inhibited.

Furthermore, it is desirable that the particle diameter D of the Nd crystal grain 81 is approximately 0.3 μm. Also, approximately 2 nm in thickness d of the refractory metal 82 is enough to prevent the grain growth of the Nd magnet particles upon sintering, and to disrupt exchange interaction among the Nd crystal grains 81. However, if the thickness d of the refractory metal 82 excessively increases, the rate of nonmagnetic components which exert no magnetic properties becomes large, so that the residual magnet flux density becomes low.

Figure 4:
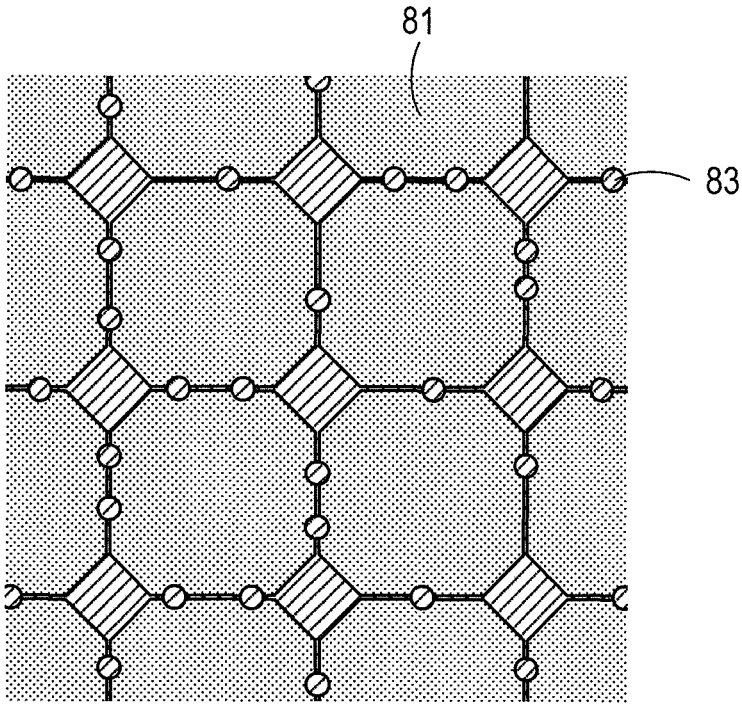
[FIG. 4] is an enlarged schematic view in vicinity of grain boundaries of the permanent magnet directed to the invention.

However, as a configuration for concentrating refractory metal on the grain boundaries of the Nd crystal grains 81, there may be employed, as illustrated in FIG. 4, a configuration in which agglomerates 83 composed of refractory metal are scattered onto the grain boundaries of the Nd crystal grains 81. The similar effect (such as inhibiting grain growth and disrupting exchange interaction) can be obtained even in such a configuration as illustrated in FIG. 4. The concentration of refractory metal in the grain boundaries of the Nd crystal grains 81 can be confirmed, for instance, through scanning electron microscopy (SEM), transmission electron microscopy (TEM) or three-dimensional atom probe technique.

As has been discussed above, in the permanent magnet and the method for manufacturing thereof according to the present embodiment, an electrolytic solution is obtained through dissolving chloride or injecting hydrogen chloride gas into the alcohol that is the same as a constituent element of the metal alkoxide to be manufactured. Then, electrolysis is performed using, for an anode, a ferroalloy that contains iron and metal which is the same metal as is a constituent element of the metal alkoxide to be manufactured in a predetermined weight ratio (such as 1:1), and using, for a cathode, the same ferroalloy, carbon, platinum or stainless steel, so as to obtain an alcohol solution of the metal alkoxide. Accordingly, there is no need for processes such as a metal refining process, a reaction process of metal and chlorine gas and a conversion process from metal chloride to metal alkoxide. Compared to the conventional method, the work environment is improved and metal alkoxide can be manufactured with simpler production facilities and manufacturing processes. Further, manufacturing costs can also be reduced. In addition, as a ferroalloy can be used for an anode and a cathode, metal refining for the metal to be used for the anode and the cathode can also become unnecessary, compared with a case where only the metal which is a constituent element of metal alkoxide to be manufactured is used as the anode and the cathode.

Further, through performing electrolysis and introducing ammonia gas in the alcohol solution of the metal alkoxide, the precipitate of ammonium chloride is deposited and removed from the alcohol solution of the metal alkoxide. As a result, it is made possible to remove the chloride ion contained in the alcohol solution of the metal alkoxide after electrolysis, and also possible to obtain the alcohol solution of the metal alkoxide with a smaller amount of impure substances.

Further, in the method for manufacturing the permanent magnet according to the embodiment, the metal alkoxide is added to the magnet powder in the manufacturing process in a state of the alcohol solution of the metal alkoxide, which eliminates the need for the process in which the metal alkoxide is taken out from the alcohol solution of the metal alkoxide through distillation. As a result, it is made possible to simplify the manufacturing process of the metal alkoxide and the permanent magnet. Furthermore, it becomes possible to make the metal alkoxide containing M evenly adhere on each particle surface of the magnet particles, so that M can be effectively concentrated with respect to the grain boundaries of the magnet after sintering.

As a result, for instance, if M is refractory metal such as V, Mo, Zr, Ta, Ti, W or Nb, grain growth can be prevented in the magnet particles at sintering, and at the same time exchange interaction can be disrupted among the magnet particles so as to prevent magnetization reversal in the magnet particles, making it possible to improve the magnetic performance thereof.

Meanwhile, if M is Dy or Tb, a very small amount of Dy or Tb can be efficiently concentrated in a grain boundary of the magnet. Consequently, usage of Dy or Tb is reduced while improvement of coercive force can be sufficiently realized.

Not to mention, the present invention is not limited to the above-described embodiment but may be variously improved and modified without departing from the scope of the present invention.

In the above embodiment, niobium-iron ethoxide is used as metal alkoxide to be manufactured and yet the above method can be applied for manufacturing other types of metal alkoxide. However, it is preferable that the other types of metal alkoxide include any one of V, Mo, Zr, Ta, Ti, W or Nb, for the purposes of inhibiting the grain growth of magnet particles at sintering and disrupting exchange interaction among the magnet particles in the manufacturing process of the permanent magnet. Furthermore, as to the alcohol to form the metal alkoxide, it is preferable to use methanol, isopropanol, propanol, butanol, or the like, other than ethanol.

Furthermore, in the above method for manufacturing the permanent magnet, the metal alkoxide is added to the magnet powder in the manufacturing process in a state of the alcohol solution of the metal alkoxide without distillation of the alcohol solution of the metal alkoxide; however, the configuration may be such that the metal alkoxide may be taken out separately from the alcohol solution of the metal alkoxide through distillation of the alcohol solution of the metal alkoxide, dissolved into some solvent and added to the magnet powder in a wet state.

In the above manufacturing method of permanent magnet, alloy composition of a neodymium magnet employs fractions according to the stoichiometric composition (Nd: 26.7 wt %, Fe (electrolytic iron) : 72.3 wt %, B: 1.0 wt %). However, proportion of Nd in the neodymium magnet powder may be set higher in comparison with the fractions according to the stoichiometric composition. The fractions may be such as Nd/Fe/B=32.7/65.96/1.34 in wt %, for instance.

Further, of magnet powder, milling condition, mixing condition, calcination condition, sintering condition, etc. are not restricted to conditions described in the embodiment. Further, hydrogen calcination process may be omitted.

EXPLANATION OF REFERENCES

1 permanent magnet
81 Nd crystal grain
82 refractory metal layer
83 refractory metal agglomerate

The invention claimed is:

1. A manufacturing method of a permanent magnet comprising steps of:

preparing an electrolytic solution through one of dissolving chloride or injecting hydrogen chloride gas into alcohol which is a same alcohol as is a constituent element of metal alkoxide to be manufactured;

performing electrolysis on the electrolytic solution while using, for an anode, a ferroalloy containing iron and M, M representing metal which is a constituent element of the metal alkoxide to be manufactured, in a predetermined weight ratio and, for a cathode, one of the ferroalloy, carbon, platinum or stainless steel, to obtain an alcohol solution of the metal alkoxide;

milling magnet material into magnet powder;

adhering the metal alkoxide to particle surfaces of the magnet powder through adding the metal alkoxide contained in the alcohol solution of the metal alkoxide obtained at the step of performing electrolysis to the magnet powder obtained at the step of milling magnet material;

compacting the magnet powder having the metal alkoxide adhered on the particle surfaces thereof so as to obtain a compact body; and sintering the compact body, and wherein the permanent magnet is Nd—Fe—B based.

2. The manufacturing method of a permanent magnet according to claim 1 further comprising steps of:

introducing ammonia gas into the alcohol solution of the metal alkoxide obtained at the step of performing electrolysis, to deposit ammonium chloride precipitate; and removing the ammonium chloride precipitate from the alcohol solution of the metal alkoxide, wherein in the step of adhering the metal alkoxide to particle surfaces of the magnet powder, the alcohol solution of the metal alkoxide from which the ammonium chloride precipitate is removed is added to the magnet powder obtained at the step of milling magnet material.

3. The manufacturing method of a permanent magnet according to claim 1, wherein, in the step of adhering the metal alkoxide to particle surfaces of the magnet powder, the alcohol solution of the metal alkoxide obtained at the step of performing electrolysis is mixed with the magnet powder obtained at the step of milling magnet material so as to add the metal alkoxide in a wet state.

4. The manufacturing method of a permanent magnet according to claim 2, wherein, in the step of adhering the metal alkoxide to particle surfaces of the magnet powder, the alcohol solution of the metal alkoxide from which the ammonium chloride precipitate is removed is mixed with the magnet powder obtained at the step of milling magnet material so as to add the metal alkoxide in a wet state.

5. The manufacturing method of a permanent magnet according to claim 1, wherein M includes one of vanadium, molybdenum, zirconium, tantalum, titanium, tungsten or niobium.

* * * * *